US007153339B2

(12) United States Patent
Lindsley et al.

(10) Patent No.: US 7,153,339 B2
(45) Date of Patent: Dec. 26, 2006

(54) POWDER METALLURGICAL COMPOSITIONS AND METHODS FOR MAKING THE SAME

(75) Inventors: Bruce Lindsley, Cinnaminson, NJ (US); Patrick King, Somerset, NJ (US); Christopher T. Schade, Marlton, NJ (US)

(73) Assignee: Hoeganaes Corporation, Cinnaminson, NJ (US)

( * ) Notice: Subject to any disclaimer, the term of this patent is extended or adjusted under 35 U.S.C. 154(b) by 12 days.

(21) Appl. No.: 10/818,782

(22) Filed: Apr. 6, 2004

(65) Prior Publication Data

US 2005/0220657 A1 Oct. 6, 2005

(51) Int. Cl.
*B22F 1/00* (2006.01)
*B22F 3/12* (2006.01)

(52) U.S. Cl. ..... 75/255; 75/252; 419/39

(58) Field of Classification Search ..... 75/252, 75/255; 419/38, 39
See application file for complete search history.

(56) References Cited

U.S. PATENT DOCUMENTS

| | | | | | |
|---|---|---|---|---|---|
| 3,689,257 | A | * | 9/1972 | Oda | 419/47 |
| 4,071,354 | A | * | 1/1978 | Mocarski | 75/255 |
| 4,263,046 | A | | 4/1981 | Fichte et al. | 75/252 |
| 4,483,905 | A | | 11/1984 | Engstrom | 428/570 |
| 4,556,533 | A | | 12/1985 | Oaku et al. | 419/11 |
| 4,690,711 | A | * | 9/1987 | Coad | 75/244 |
| 4,834,800 | A | | 5/1989 | Semel | 106/403 |
| 4,913,739 | A | | 4/1990 | Thümmler et al. | 75/243 |
| 5,069,714 | A | | 12/1991 | Gosselin | 75/252 |
| 5,108,493 | A | | 4/1992 | Causton | 75/255 |
| 5,217,683 | A | | 6/1993 | Causton | 419/38 |
| 5,290,336 | A | | 3/1994 | Luk | 75/231 |
| 5,298,055 | A | | 3/1994 | Semel et al. | 75/252 |
| 5,330,792 | A | | 7/1994 | Johnson et al. | 427/217 |
| 5,368,630 | A | | 11/1994 | Luk | 75/252 |
| 5,498,276 | A | | 3/1996 | Luk | 75/252 |
| 5,516,483 | A | * | 5/1996 | Shivanath et al. | 419/14 |
| 5,834,640 | A | * | 11/1998 | Shivanath et al. | 75/243 |
| 5,872,322 | A | * | 2/1999 | Mocarski et al. | 75/246 |
| 5,969,276 | A | | 10/1999 | Lindberg | 75/246 |
| 6,123,748 | A | * | 9/2000 | Whitaker et al. | 75/252 |
| 6,126,894 | A | * | 10/2000 | Moxson | 419/2 |
| 6,364,927 | B1 | | 4/2002 | Narasimhan et al. | 75/252 |
| 6,783,568 | B1 | * | 8/2004 | Bowskill et al. | 75/246 |

FOREIGN PATENT DOCUMENTS

| | | |
|---|---|---|
| EP | 0 097 737 | 1/1984 |
| GB | 1 535 409 | 12/1978 |
| WO | WO 99/20689 | 4/1999 |

OTHER PUBLICATIONS

Salak, A., "Ferrous Powder Metallurgy", *Preparation and Characteristics of Powder Structural Iron-Based Materials*, 1995, 169-171.

* cited by examiner

*Primary Examiner*—Ngoclan T. Mai
(74) *Attorney, Agent, or Firm*—Woodcock Washburn LLP

(57) ABSTRACT

Metallurgical powder compositions of the present invention include an iron based powder combined with a master alloy powder, as a mechanical property enhancing powder. The addition of master alloy powders has been found to enhance the mechanical properties of the final, sintered, compacted parts made from metallurgical powder compositions, especially at low sintering temperatures. Metallurgical powder compositions include at least about 80 weight percent of an iron-based metallurgical powder and from about 0.10 to about 20 weight percent of a master alloy powder. Master alloy powders include iron and from about 1.0 to about 40 weight percent chromium, and from about 1.0 to about 35 weight percent silicon, based on the weight of the master alloy powder.

32 Claims, 10 Drawing Sheets

POWDER METALLURGICAL COMPOSITIONS AND METHODS FOR MAKING THE SAME

FIELD OF THE INVENTION

This invention relates to metal-based, metallurgical powder compositions, and more particularly, to powder compositions that include a master alloy powder for enhancing the mechanical properties of compacted parts.

BACKGROUND OF THE INVENTION

Iron-based particles have long been used as a base material in the manufacture of structural components by powder metallurgical methods. The iron-based particles are first molded in a die under high pressures to produce a desired shape. After the molding step, the compacted or "green" component usually undergoes a sintering step to impart the necessary strength to the component.

The mechanical properties of compacted and sintered components can be greatly increased by the addition of certain metallurgical additives, such as for example, alloying elements. Alloy steels, for example, are traditionally prepared by mechanically mixing powder alloy additions in elemental form or as oxides. Although convenient due to its simplicity, a disadvantage of this technique is that the resulting alloyed compositions have a heterogeneous structure determined by the thermodynamic and diffusion characteristics of each elemental component. In addition, there have traditionally been problems in preparing homogeneous admixtures where particles of alloying materials are uniformly distributed and would not segregate during transport and handling.

The cost associated with utilizing commonly used metallurgical additives is another disadvantage because it can unfortunately add up to a significant portion of the overall cost of the powder composition. Accordingly, it has always been of interest in the powder metallurgical industry to try to develop less costly metallurgical additives to reduce and/or replace entirely the commonly used alloying elements, such as for example copper or nickel.

Another disadvantage of using metallurgical alloying additives is that they may also impart undesired properties to metallurgical composition. For example, manufacturers of powder metallurgy parts generally desire to limit the amount of copper and/or nickel used in compacted metallurgical parts due to the environmental and/or recycling regulations that control the use or disposal of those parts. Moreover, addition of nickel based metallurgical additives commonly results in the undesirable shrinkage of compacted parts when sintered at high temperatures. The powder metallurgical industry seeks to minimize shrinkage to ensure the dimensions of sintered parts are as close as possible to the dimensions of the compaction die.

Accordingly, there exists a current and long felt need in the powder metallurgical industry to develop alternatives to the use of, or decrease the amount of, various common metallurgical additives in metallurgical powder compositions.

SUMMARY OF THE INVENTION

Metallurgical powder compositions of the present invention include an iron based powder and a master alloy powder composed of a plurality of alloying elements. Use of master alloy powders in place of elemental additive powders provides a compacted part with a more homogeneous structure. Therefore, addition of the master alloy powder has been found to enhance the mechanical properties of compacted parts made from metallurgical powder compositions.

In one embodiment, metallurgical powder compositions include at least about 80 weight percent of an iron-based metallurgical powder and from about 0.10 to about 20 weight percent of a master alloy powder. The master alloy powder includes iron, from about 0.10 to about 40 weight percent chromium, and from about 0.10 to about 30 weight percent silicon.

The present invention also provides methods for preparing metallurgical powder compositions and also methods for forming compacted and sintered metal parts from such compositions, along with the products formed by such methods. Methods of making sintered parts include compacting the metallurgical powders described above, and sintering the compacted composition. The properties of the final compacted component have been found to be obtainable at low sintering temperatures, for example below 2300° Fahrenheit. However, the properties of the final compacted component have been found to be significantly improved if the "green" compacted part is sintered at temperatures above about 2000° Fahrenheit.

DETAILED DESCRIPTION OF ILLUSTRATIVE EMBODIMENTS

Figure 1:
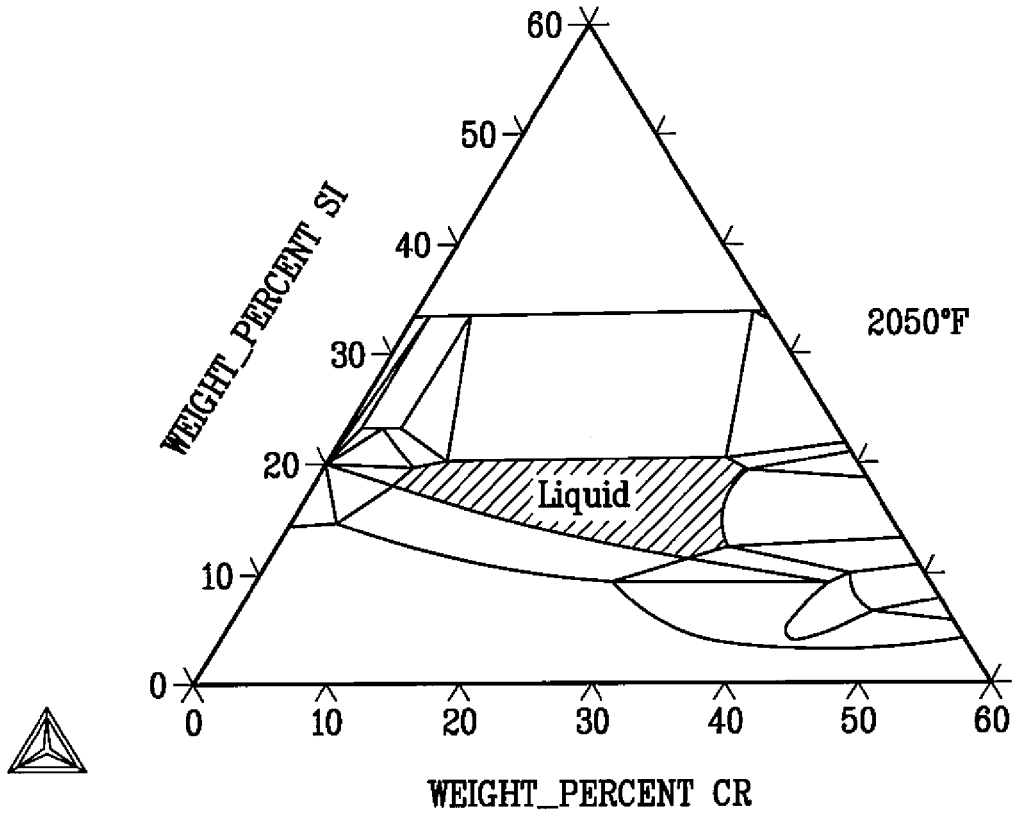
FIG. 1 is a ternary phase diagram for iron-chromium-silicon master alloy powders at 2050° Fahrenheit.

The present invention relates to metallurgical powder compositions composed of an iron-based powder and a master alloy powder composed of a plurality of alloying elements, methods for the preparation of those compositions, and methods for using those compositions to make compacted parts. The present invention also relates to the compacted parts prepared by the methods described below. Use of master alloy powders in place of elemental additive powders provides a compacted part with a more homogeneous structure. Therefore, addition of the master alloy powder has been found to enhance the mechanical properties of compacted parts made from metallurgical powder compositions.

Metallurgical powder compositions include an iron-based powder, as the major component, and a master alloy powder composed of a plurality of alloying elements, as an alloying powder for enhancing mechanical properties. As used herein "master alloy powder" refers to a prealloyed powder of high concentration of alloying materials, that will be combined with an iron-based powder to increase the alloy content of the iron-base powder and produce a metallurgical powder composition having the desired overall alloy content. The metallurgical powder compositions of the present invention also optionally include other known additives, such as for example binding agents and lubricants.

Iron based powders, as that term is used herein, are powders of substantially pure iron, powders of iron prealloyed with other elements (for example, steel-producing elements) that enhance the strength, hardenability, electromagnetic properties, or other desirable properties of the final product, and powders of iron to which such other elements have been diffusion bonded.

Substantially pure iron powders that are used in the invention are powders of iron containing not more than about 1.0% by weight, preferably no more than about 0.5% by weight, of normal impurities. Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85–3.00 g/cm3, typically 2.94 g/cm3. Other iron powders that are used in the invention are typical sponge iron powders, such as Hoeganaes' ANCOR MH-100 powder.

The iron-based powder can optionally incorporate one or more alloying elements that enhance the mechanical or other properties of the final metal part. Such iron-based powders are powders of iron, preferably substantially pure iron, that have been pre-alloyed with one or more such elements. The pre-alloyed powders are prepared by making a melt of iron and the desired alloying elements, and then atomizing the melt, whereby the atomized droplets form the powder upon solidification. Iron based powders are atomized by conventional water atomization or gas atomization techniques commonly known to those skilled in the art.

Examples of alloying elements that are admixed or prealloyed with the iron powder include, but are not limited to, molybdenum, manganese, magnesium, chromium, silicon, copper, nickel, vanadium, columbium (niobium), carbon, phosphorus, aluminum, and combinations thereof. The amount of the alloying element or elements incorporated depends upon the properties desired in the final composition. Pre-alloyed iron-based powders that incorporate such alloying elements are available from Hoeganaes Corp. as part of its ANCORSTEEL line of powders.

Iron based powders include less than 20 weight percent of an alloying element. Preferably, iron based powders include less than 15 weight percent, and more preferably include less than 10 weight percent of an alloying element, based on the weight of the iron based powder.

Other iron-based powders that are useful in the practice of the invention are ferromagnetic powders. For example, ferromagnetic powders include powders of iron prealloyed with small amounts of phosphorus.

A further example of iron-based powders are diffusion-bonded iron-based powders which are particles of substantially pure iron that have a layer or coating of one or more other metals, such as steel-producing elements, diffused into their outer surfaces. Such commercially available powders include DISTALOY 4600A diffusion bonded powder from Hoeganaes Corporation, which contains about 1.8% nickel, about 0.55% molybdenum, and about 1.6% copper, and DISTALOY 4800A diffusion bonded powder from Hoeganaes Corporation, which contains about 4.05% nickel, about 0.55% molybdenum, and about 1.6% copper.

The particles of iron have a weight average particle size as small as one micron or below, or up to about 850–1,000 microns as determined by laser light scattering techniques, but generally the particles will have a weight average particle size in the range of about 10–500 microns. Preferred particle sizes are iron or pre-alloyed iron particles having a maximum weight average particle size up to about 350 microns; more preferably the particles will have a weight average particle size in the range of about 25–150 microns, and most preferably 80–150 microns.

Iron-based powders constitute a major portion of the metallurgical powder composition, and generally constitute at least about 80 weight percent, preferably at least about 85 weight percent, and more preferably at least about 90 weight percent. Master alloy powders constitute a minor portion of the metallurgical powder composition, and generally constitute no more than 20 weight percent of the metallurgical powder composition. Preferably, master alloy powders are present in metallurgical compositions from about 0.5 to about 10 weight percent.

Master alloy powders are prealloyed powders that include iron and a plurality of alloying elements. Examples of alloying elements that are included in master alloy powders include, but are not limited to, molybdenum, manganese, chromium, silicon, copper, nickel, vanadium, columbium (niobium), carbon, phosphorus, and combinations thereof. The amount of the alloying element or elements incorporated depends upon the properties desired in the final composition. Preferably, master alloy powders are composed of iron, silicon, chromium, and manganese. More preferred master alloy powders are composed of iron, silicon, and chromium.

Master alloy powders are prepared by melt blending iron-based powders and a plurality of alloying elements using conventional techniques. The melt blend is then atomized, crushed, or ground using conventional techniques to obtain master alloy powder particles. Preferred particle sized powders are then segregated using conventional separation techniques.

Addition of master alloy powders to iron based powders overcomes disadvantages associated with incorporating individual elemental alloying powders, such as for example, forming concentrations of alloying elements in "islands." The concentration of a given alloying material in the master alloy powder is lower than the concentration in elemental alloying powders. As a result, the number of master alloy powder particles required to obtain a specific content of an alloying element is higher compared with addition of an elemental alloying additive. Using more alloying additive, i.e., master alloy powder, distributes the alloying element throughout a compact better than addition of elemental alloying additives, even before sintering, thereby distributing the alloying elements more uniformly in the compacted part. The result of using master alloyed powders is a more homogeneous structure upon sintering compared to individual elemental alloying powders.

Processes concerning alloying additives containing iron and a transition metal, e.g., chromium, manganese, vanadium, or columbium, are disclosed in U.S. Pat. No. 5,217,683, which is herein incorporated by reference in its entirety. Processes concerning silicon carbide alloying additives are disclosed in U.S. Pat. No. 6,364,927, which is herein incorporated by reference in its entirety.

Although chromium, manganese, and silicon are efficient in strengthening components manufactured using powder metallurgy techniques, elemental powders of these materials have a high affinity for oxygen and readily oxidize during processing. For example, chromium oxide, manganese oxide, and silicon oxide can form during atomization with water, unless atomization conditions are rigorously controlled. Powder compositions composed of an iron-base powder and a master alloy powder exhibit lower oxygen content compared with fully prealloyed powders composed of the same alloying materials. Without being limited by theory, it is believed that master alloy powders form a thin, silicon rich oxide barrier on the surface of each powder particle that prevents further oxidation during atomization and subsequent processing. In one embodiment, the master alloy powder includes a plurality of alloying elements that have been melt blended with a low oxygen content iron-based powder to reduce the oxygen content of the master alloy powder. Low oxygen content iron-based powders include those iron based powders known to those skilled in the art.

Master alloy powders advantageously have a melting point lower than the individual melting point of each alloying element comprising the master alloy. Without being limited by theory, it is believed that the low melting point of the master alloy compared to elemental and binary alloying systems enables the alloying elements to be distributed, e.g., diffused, more efficiently and more effectively through the compacted part upon heating. As a result, even when sintered at lower temperatures for shorter times, metallurgical powder compositions incorporating master alloy powders achieve similar mechanical properties as metallurgical powder compositions composed of individual elemental alloying additives. During sintering, master alloy powders can be a solid, liquid, or a mixture of liquid and solid.

Figure 2:
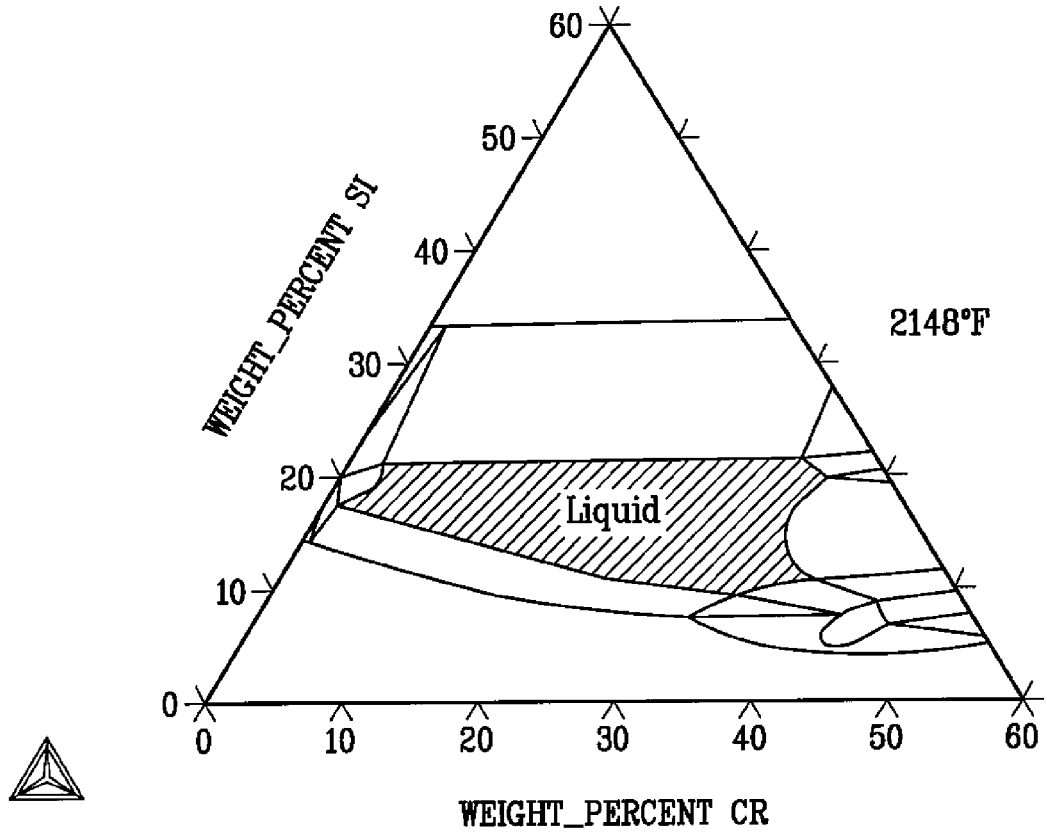
FIG. 2 is a ternary phase diagram for iron-chromium-silicon master alloy powders at 2147° Fahrenheit.

FIG. 1 is a ternary phase diagram for iron-chromium-silicon master alloy powders at 2050° Fahrenheit. FIG. 2 is a ternary phase diagram for iron-chromium-silicon master alloy powders at 2147° Fahrenheit. Referring to FIGS. 1 & 2, the hatched region of the iron-chromium-silicon ternary diagrams represent preferred compositions of master alloy powders. As shown in FIGS. 1 & 2, the liquid phase field increases in size as temperature is increased thereby providing a broader liquid sintering temperature range.

In comparison, the three possible binary systems, i.e., Fe—Cr, Fe—Si, and SiCr, exhibit substantially higher melting points (1200° C., 1513° C., and 1335° C. respectively). When compared to these binary systems, iron-chromium-silicon master alloy powders diffuse more quickly through the porosity of a compacted part without the need for costly high temperature sintering furnaces.

Master alloy powders generally include from about 0.10 to about 35 weight percent, and more typically, from about 1.0 to about 35 weight percent silicon based on the total weight of the metallurgical powder compositions. Preferably, master alloy powders include from about 10 to about 35 weight percent silicon. Even more preferably, master alloy powders include from about 15 to about 25 weight percent silicon. Still more preferably, master alloy powders include from about 15 to about 22 weight percent silicon.

Master alloy powders generally also include from about 0.10 to about 40 weight percent, and more typically from about 1.0 to about 40 weight percent chromium based on the total weight of the metallurgical powder compositions. Preferably, master alloy powders include from about 10 to about 35 weight percent chromium. Even more preferably, master alloy powders include from about 15 to about 35 weight percent chromium.

In one embodiment, the master alloy powder includes iron, about 18 weight percent silicon, and about 29 weight percent chromium. In another embodiment, the master alloy powder includes iron, about 20 weight percent silicon, about 24 weight percent chromium.

In still another embodiment, master alloy powders include up to 35 weight percent manganese. Preferable, master alloy powders includes from about 1.0 to about 35 weight percent manganese. More preferably, master alloy powders includes from about 10 to about 30 weight percent manganese. Still more preferably, master alloy powders includes from about 15 to about 25 weight percent manganese.

In one embodiment, the master alloy powder includes iron and from about 1.0 to about 35 weight percent silicon, from about 1.0 to about 40 weight percent chromium, and from about 1.0 to about 35 weight percent manganese, based on the total weight of the metallurgical powder composition. Preferably, the master alloy powder includes iron and about 14 weight percent silicon, about 20 weight percent chromium, and about 20 weight percent manganese.

In yet another embodiment, master alloy powders include up to 5 weight percent carbon. Preferable, master alloy powders includes from about 0.10 to about 5 weight percent carbon. More preferably, master alloy powders includes from about 0.1 to about 1.0 weight percent carbon.

In another embodiment, master alloy powders include up to 25 weight percent nickel. Preferably, master alloy powders include from about 1.0 to about 20 weight percent nickel. More preferably, master alloy powders includes from about 5 to about 15 weight percent nickel.

Master alloy powders are in the form of particles that are generally of finer size than the particles of iron-based powder with which they are admixed. Master alloy powder generally have a weight average particle size below about 100 microns, preferably below about 75 microns, more preferably below about 33 microns, and most preferably below about 11 microns.

The metallurgical powder compositions can also contain a lubricant powder to reduce the ejection forces when the compacted part is removed from a compaction die cavity. Examples of such lubricants include stearate compounds, such as lithium, zinc, manganese, and calcium stearates, waxes such as ethylene bis-stearamides, polyethylene wax, and polyolefins, and mixtures of these types of lubricants. Other lubricants include those containing a polyether compound such as is described in U.S. Pat. No. 5,498,276 to Luk, and those useful at higher compaction temperatures described in U.S. Pat. No. 5,368,630 to Luk, in addition to those disclosed in U.S. Pat. No. 5,330,792 to Johnson et al., all of which are incorporated herein in their entireties by reference. Lubricants are added to metallurgical powder compositions using techniques known to those skilled in the art.

The lubricant is generally added in an amount of up to about 2.0 weight percent, preferably from about 0.1 to about 1.5 weight percent, more preferably from about 0.1 to about 1.0 weight percent, and most preferably from about 0.2 to about 0.75 weight percent, of the metallurgical powder composition.

The metallurgical powder composition may also contain one or more binding agents, particularly where two or more alloying powders are used, to bond the different components present in the metallurgical powder composition so as to inhibit segregation and to reduce dusting. By "bond" as used herein, it is meant any physical or chemical method that facilitates adhesion of the components of the metallurgical powder composition. Binding agents are added to metallurgical powder compositions using techniques known to those skilled in the art.

In a preferred embodiment, bonding is carried out through the use of at least one binding agent. Binding agents that can be used in the present invention are those commonly employed in the powder metallurgical arts. For example, such binding agents include those found in U.S. Pat. No. 4,834,800 to Semel, U.S. Pat. No. 4,483,905 to Engstrom, U.S. Pat. No. 5,298,055 to Semel et. al., and in U.S. Pat. No. 5,368,630 to Luk, the disclosures of which are each hereby incorporated by reference in their entireties.

Such binding agents include, for example, polyglycols such as polyethylene glycol or polypropylene glycol; glycerine; polyvinyl alcohol; homopolymers or copolymers of vinyl acetate; cellulosic ester or ether resins; methacrylate polymers or copolymers; alkyd resins; polyurethane resins; polyester resins; or combinations thereof. Other examples of binding agents that are useful are the relatively high molecular weight polyalkylene oxide-based compositions described in U.S. Pat. No. 5,298,055 to Semel et al. Useful binding agents also include the dibasic organic acid, such as azelaic acid, and one or more polar components such as polyethers (liquid or solid) and acrylic resins as disclosed in U.S. Pat. No. 5,290,336 to Luk, which is incorporated herein by reference in its entirety. The binding agents in the '336 patent to Luk can also act advantageously as a combination of binder and lubricant. Additional useful binding agents include the cellulose ester resins, hydroxy alkylcellulose resins, and thermoplastic phenolic resins described in U.S. Pat. No. 5,368,630 to Luk.

The binding agent can further be low melting, solid polymers or waxes, e.g., a polymer or wax having a softening temperature of below 200° C. (390° F.), such as polyesters, polyethylenes, epoxies, urethanes, paraffins, ethylene bisstearamides, and cotton seed waxes, and also polyolefins with weight average molecular weights below 3,000, and hydrogenated vegetable oils that are $C_{14-24}$ alkyl moiety triglycerides and derivatives thereof, including hydrogenated derivatives, e.g. cottonseed oil, soybean oil, jojoba oil, and blends thereof, as described in WO 99/20689, published Apr. 29, 1999, which is hereby incorporated by reference in its entirety herein. These binding agents can be applied by the dry bonding techniques discussed in that application and in the general amounts set forth above for binding agents. Further binding agents that can be used in the present invention are polyvinyl pyrrolidone as disclosed in U.S. Pat. No. 5,069,714, which is incorporated herein in its entirety by reference, or tall oil esters.

The amount of binding agent present in the metallurgical powder composition depends on such factors as the density, particle size distribution and amounts of the iron based powder and master alloy powder in the metallurgical powder composition. Generally, the binding agent will be added in an amount of at least about 0.005 weight percent, more preferably from about 0.005 weight percent to about 2 weight percent, and most preferably from about 0.05 weight percent to about 1 weight percent, based on the total weight of the metallurgical powder composition.

The components of the metallurgical powder compositions of the invention can be prepared following conventional powder metallurgy techniques. Generally, the iron based powder, master alloy powder, and optionally the solid lubricant and/or binder (along with any other additive, such as an alloying additive) are admixed together using conventional powder metallurgy techniques, such as the use of a double cone blender. The blended powder composition is then ready for use.

The metallurgical powder compositions are formed into compacted parts using conventional techniques. The compacting may be carried out at temperatures ranging from room temperature to about 375° C. In any compaction technique, a lubricant, usually in an amount up to about 1 percent by weight, can be mixed into the powder composition or applied directly on the die or mold wall. Use of the lubricant reduces stripping and sliding pressures associated with extracting a compacted component from a die cavity. Typically, the metallurgical powder composition is poured into a die cavity and compacted under pressure, such as between about 5 and about 200 tons per square inch (tsi), more commonly between about 10 and 100 tsi. Preferably the metallurgical powder composition is compacted at a pressure from about 30 to about 80 tsi, and more preferably from about 40 to about 80 tsi. The compacted part is then ejected from the die cavity.

Compacted ("green") parts may be sintered to enhance mechanical properties, for example strength. Green parts are sintered at conventional sintering temperatures known to those skilled in the art. Sintering techniques are described in, for example, U.S. Pat. No. 5,969,276, which is herein incorporated by reference in its entirety.

Preferably, green parts are sintered at a temperature of no less than about 2000° F., however, typically compacted parts are sintered at a temperature of no less than about 2050° F. For example, green compacts are sintered at a temperature of from about 2000° F. to about 2150° F. The mechanical properties of green parts have been found to improve if sintered at temperatures greater than about 2150° F., preferably above about 2200° F., more preferably above about 2250° F., and even more preferably above about 2300° F. For example, green compacts are sintered at a temperature of from about 2000° F. to about 2400° F.

The compacted component is maintained at the sintering temperature for a time sufficient to achieve metallurgical bonding and alloying. Generally, heating is required for about 0.5 hours to about 3 hours, more preferably from about 0.5 hours to about 1 hour, depending on the size and initial temperature of the compacted component. The sintering is preferably conducted in an inert atmosphere such as nitrogen, hydrogen, or a noble gas such as argon. Also, the sintering is preferably performed after the compacted component has been removed from the die.

It is preferred, as shown in the following examples, to sinter the metallurgical powder composition at a temperature that will cause alloying elements contained in the master alloy powder to diffuse into the iron matrix of the iron-based powder such that it alloys with the iron. Additional processes such as forging or other appropriate manufacturing technique or secondary operation may be used to produce the finished part. For example compacted parts can be optionally heat treated. Heat treatments to further improve mechanical properties include those known to those skilled in the art, such as for example tempering.

Some embodiments of the present invention will now be described in detail in the following Examples. Metallurgical powder compositions were prepared and formed into compacted components in accordance with the methods of the present invention. Also, other iron powders were prepared and formed into core components for comparative purposes. The core components formed were evaluated for mechanical properties.

EXAMPLES

The following examples, which are not intended to be limiting, present certain embodiments and advantages of the present invention. Unless otherwise indicated, any percentages are on a weight basis.

Physical properties of powder mixtures and of the green and sintered compacts were determined generally in accordance with the following test methods of the American Society for Testing and Materials and the Metal Powder Industries Federation:

| Property | Test Method |
|---|---|
| Green Density (g/cm3) | ASTM B331-76 |
| Green Strength (psi) | ASTM B312-76 |
| Dimensional Change (%) | ASTM B610-76 |
| Transverse Rupture Strength (ksi) | MPIF Std. 41 |
| Ultimate Tensile Strength (ksi) | MPIF Std. 10 |
| Impact Energy (ft · $lb_f$) | MPIF Std. 40 |

Example 1

Metallurgical powder compositions containing master alloy powders were evaluated and compared to a reference powder without addition of an alloying powder and a reference powder composed of a chromium containing powder additive and a separate silicon containing powder additive. Reference Powder I included an iron based powder admixed with 0.75 weight percent of an ethylene bisstearamide wax lubricant (commercially available as Acrawax, from Glycol Chemical Co.) and 0.6 weight percent carbon (commercially available as 3203 graphite, from Asbury Graphite Mills). The iron based powder was an iron powder prealloyed with 0.85 weight percent molybdenum (commercially available as Ancorsteel 85 HP, from Hoeganaes Corp.).

Reference Powder II was prepared by admixing Reference Powder I with an iron-chromium-carbon alloying additive powder having a weight average particle size of 9.3 microns, (commercially available as High Carbon Ferrochrome powder, from F. W. Winter Co.) and a conventional silicon containing additive powder having a weight average particle size of 7.6 microns. Once admixed with both additive powders, Reference Composition II included 0.4 weight percent chromium, 0.35 weight percent silicon.

Test Compositions I was prepared by admixing Reference Powder I with a master alloy powder. The master alloy powder included 24.0 weight percent chromium, 20.0 weight percent silicon, and 56 weight percent iron, based on the weight of the master alloy, and had a weight average particle size of 11 microns. With addition of the master alloy powder, Test Composition I included 0.4 weight percent chromium and 0.35 weight percent silicon.

Each powder composition was pressed at 45 tons per square inch. Bars measuring 0.25 inches high, 0.5 inches wide, and 1.25 inches long were prepared for Transverse Rupture Strength testing. Additional samples were prepared for tensile strength testing. The compacts were then sintered in a 90% nitrogen and 10% hydrogen atmosphere at two different commercial sintering temperatures, i.e., 2050 degrees Fahrenheit and 2300 degrees Fahrenheit respectively.

Table 1 shows mechanical properties for the reference compositions and Test Composition I at a sintering temperature of 2050° F.:

TABLE 1

| | Transverse Rupture Strength (psi) | Ultimate Tensile Strength (psi) |
|---|---|---|
| Reference Powder I | 144,000 | 68,900 |
| Reference Powder II | 146,000 | 73,900 |
| Test Composition I | 170,000 | 88,900 |

Table 2 shows mechanical properties for the reference compositions and Test Composition I at a sintering temperature of 2300° F.:

TABLE 2

| | Transverse Rupture Strength (psi) | Ultimate Tensile Strength (psi) |
|---|---|---|
| Reference Powder I | 154,000 | 76,400 |
| Reference Powder II | 196,000 | 90,300 |
| Test Composition I | 204,000 | 99,800 |

Figure 3:
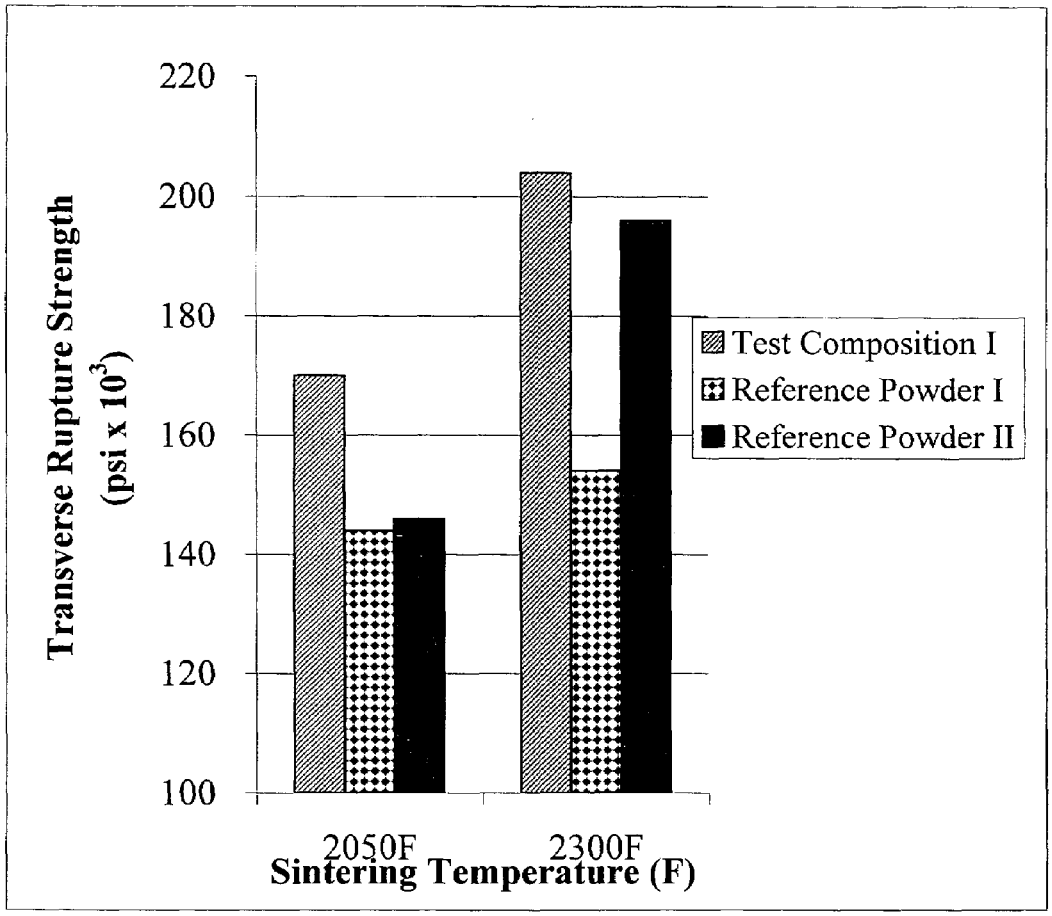
FIG. 3 is a bar graph of transverse rupture strength properties of metallurgical powder compositions and reference compositions after sintering at 2050 and 2300 degrees Fahrenheit.
Figure 4:
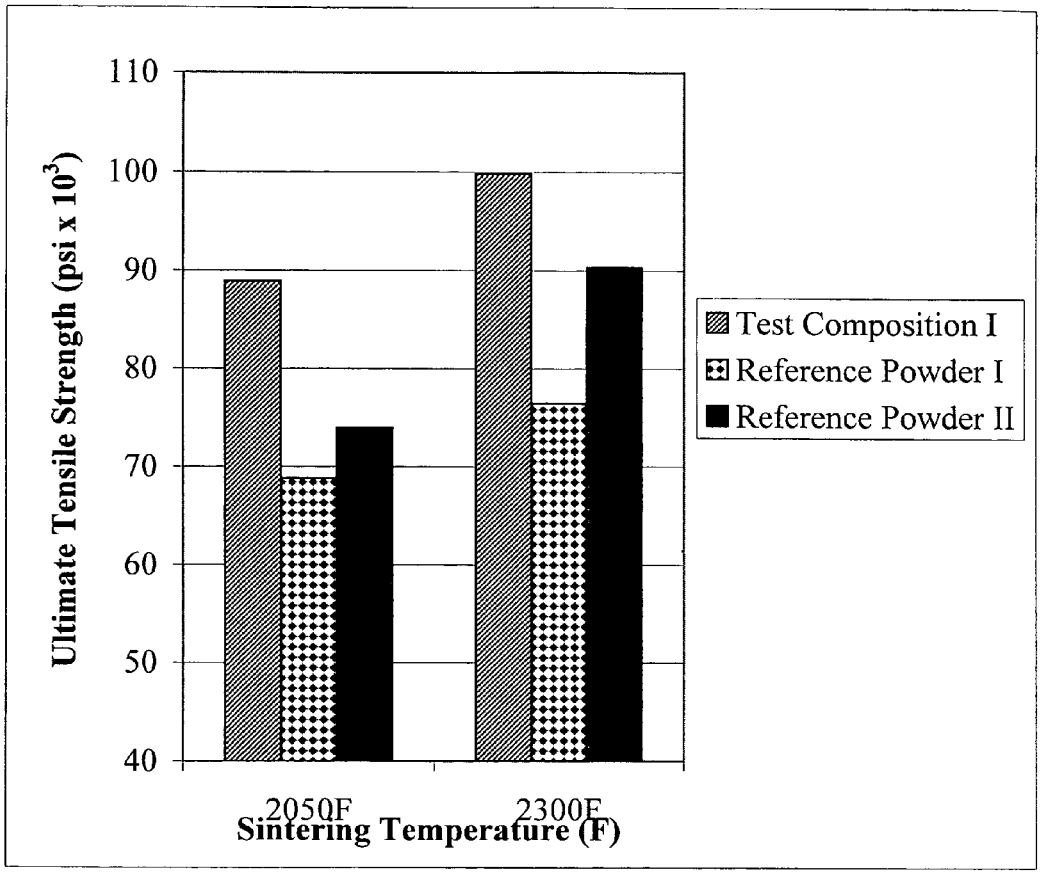
FIG. 4 is a bar graph of ultimate tensile strength properties of metallurgical powder compositions and reference compositions after sintering at 2050 and 2300 degrees Fahrenheit.

FIG. 3 is a bar graph of transverse rupture strength properties of metallurgical powder compositions and reference compositions after sintering at 2050 and 2300 degrees Fahrenheit. FIG. 4 is a bar graph of ultimate tensile strength properties of metallurgical powder compositions and reference compositions after sintering at 2050 and 2300 degrees Fahrenheit. Referring to FIGS. 3 & 4, after sintering at 2050 and 2300 degrees Fahrenheit, Test Composition I exhibited higher transverse rupture strength and higher ultimate tensile strength compared to Reference Powders I and II. After sintering at 2300 degrees Fahrenheit, Test Composition I exhibited higher transverse rupture strength and higher ultimate tensile strength compared to Test Composition I sintered at 2050 degrees Fahrenheit.

Without being limited by theory, it is believed that strength of metallurgical powder compositions composed of the master alloy powder increase in strength as sintering temperature and time are increased. Higher sintering temperature temperatures and longer sintering times provide improved diffusion of master alloy powders, which improves the strength of sintered compacts.

Example 2

Metallurgical powder compositions, Test Compositions I–V, were prepared with master alloy powders having different weight average particle sizes. Each of Test Compositions I–V was prepared by admixing Reference Powder I with a master alloy powder having 24.0 weight percent chromium, 20.0 weight percent silicon, and 56 weight percent iron, based on the total weight of the master alloy. With addition of the master alloy powder, each test composition included 0.4 weight percent chromium and 0.35 weight percent silicon.

The master alloy powder of Test Composition I, as described in Example I, had a weight average particle size of 11 μm. The master alloy powder of Test Composition II had a weight average particle size of 8 μm. The master alloy powder of Test Composition III had a weight average particle size of 18 μm. The master alloy powder of Test Composition IV had a weight average particle size of 26 μm. The master alloy powder of Test Composition V had a weight average particle size of 45 μm.

Each Test Composition was pressed into bars as described in Example I and sintered at 2050 and 2300 degrees Fahrenheit in an atmosphere composed of 90% nitrogen and 10% hydrogen. Table 3a shows mechanical properties for Test Compositions I–V at a sintering temperature of 2050° F.:

TABLE 3a

| | Particle Size (μm) | Transverse Rupture Strength (psi) | Yield Strength | % Elongation | Ultimate Tensile Strength (psi) |
|---|---|---|---|---|---|
| Test Composition I | 11 | 170,000 | 67.9 | 1.63 | 67,900 |
| Test Composition II | 8 | 168,000 | — | — | — |
| Test Composition III | 18 | 159,000 | — | — | — |
| Test Composition IV | 26 | 153,000 | — | — | — |
| Test Composition V | 45 | 141,000 | 56.2 | 1.51 | 56,200 |

Table 3b shows mechanical properties for Test Compositions I & V at a sintering temperature of 2050° F.:

TABLE 3

| | Particle Size (μm) | Yield Strength | % Elongation | Ultimate Tensile Strength (psi) |
|---|---|---|---|---|
| Test Composition I | 11 | 67.9 | 1.63 | 67,900 |
| Test Composition V | 45 | 56.2 | 1.51 | 56,200 |

Figure 5:
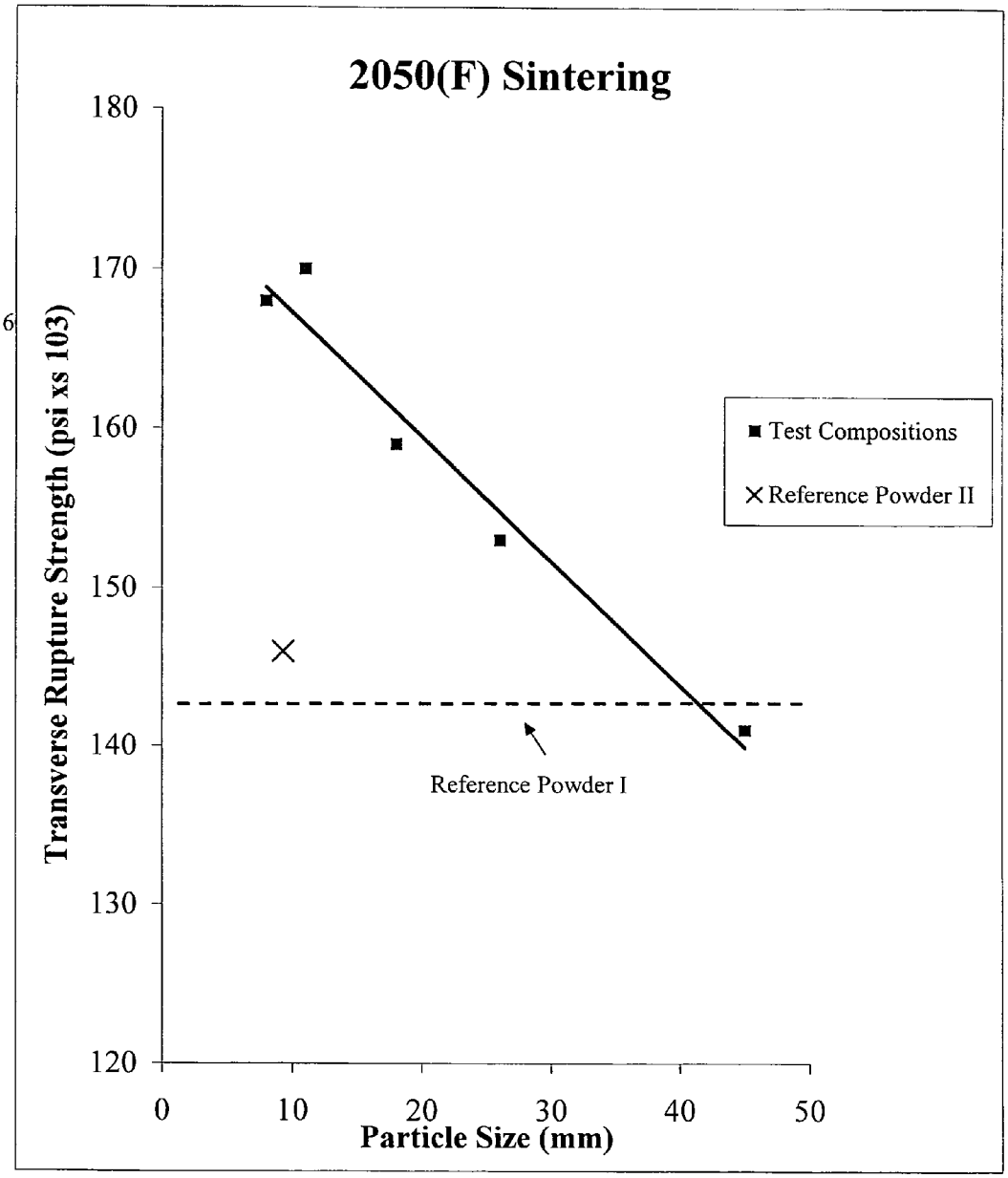
FIG. 5 is an X-Y graph of data points for transverse rupture strength properties of metallurgical powder compositions as a function of master alloy powder particle size after sintering at 2050 degrees Fahrenheit.

FIG. 5 is an X-Y graph of data points for transverse rupture strength properties of metallurgical powder compositions as a function of master alloy powder particle size after sintering at 2050 degrees Fahrenheit. Referring to FIG. 5 and Tables 1, 3a, and 3b, after sintering at 2050° F., Test Compositions I–IV, (i.e., those composed of master alloy powder with particle sized less than or equal to 26 microns), exhibited a higher transverse rupture strength compared to Reference Powders I & II. Statistical analysis of the best fit line though the data points indicates that master alloy powders having a particle size less than 37 microns have better mechanical properties compared to the Reference Powders and Test Composition V. Without being limited by theory, it is believed that master alloy powders having smaller particle sizes yield a better distribution of the alloying elements in the sintered compact thereby improving the mechanical properties of the sintered part.

Table 4 shows transverse rupture strength properties for Test Compositions I–V at a sintering temperature of 2250° F.:

TABLE 4

| | Transverse Rupture Strength (psi) |
|---|---|
| Test Composition I | 198,000 |
| Test Composition II | 199,000 |
| Test Composition IV | 189,000 |
| Test Composition V | 180,000 |

Table 5 shows mechanical properties for Test Compositions I, III, and V at a sintering temperature of 2300° F.:

TABLE 5

| | Particle Size (μm) | Transverse Rupture Strength (psi) | Yield Strength | % Elongation | Ultimate Tensile Strength (psi) |
|---|---|---|---|---|---|
| Test Composition I | 11 | 204,000 | 72.3 | 2.68 | 99,800 |
| Test Composition III | 18 | 203,000 | — | — | — |
| Test Composition V | 45 | 183,000 | 66.9 | 2.68 | 95,800 |

Test Compositions composed of smaller particle size master alloy powders exhibited higher transverse rupture strength, yield strength, and ultimate tensile strength compared to Test Compositions including larger particle size master alloy powders.

Figure 6:
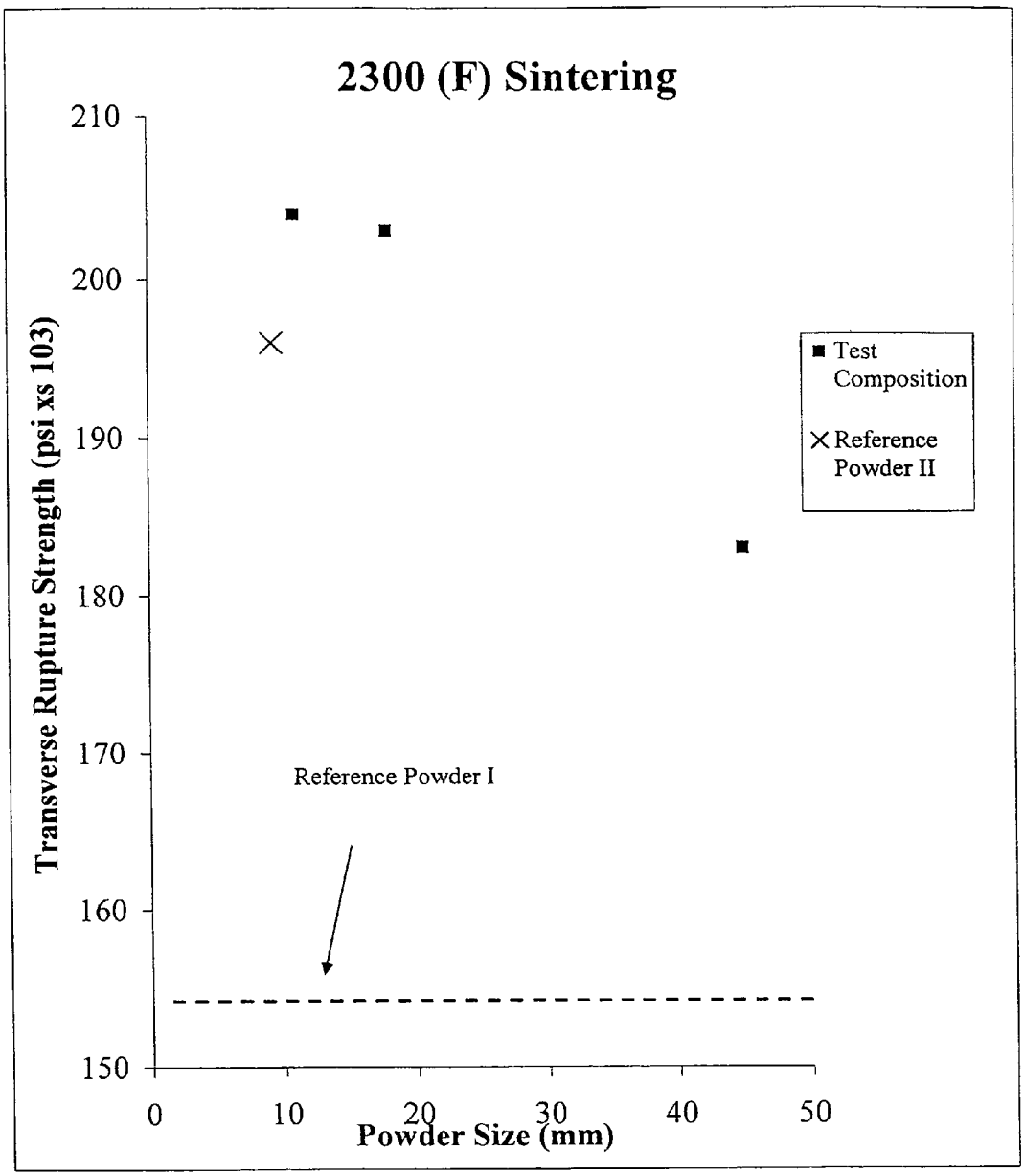
FIG. 6 is an X-Y graph of data points for transverse rupture strength properties of metallurgical powder compositions as a function of master alloy powder particle size after sintering at 2300 degrees Fahrenheit.

FIG. 6 is an X-Y graph of data points for transverse rupture strength properties of metallurgical powder compositions as a function of master alloy powder particle size after sintering at 2300 degrees Fahrenheit. Referring to FIG. 6 and Table 5, after sintering at 2300° F., Test Compositions with master alloy powders having particles sizes less than or equal to 18 microns exhibit better mechanical properties compared to compared to Test Compositions composed of larger particle size master alloy powders and Reference Powders I & II.

Figure 7:
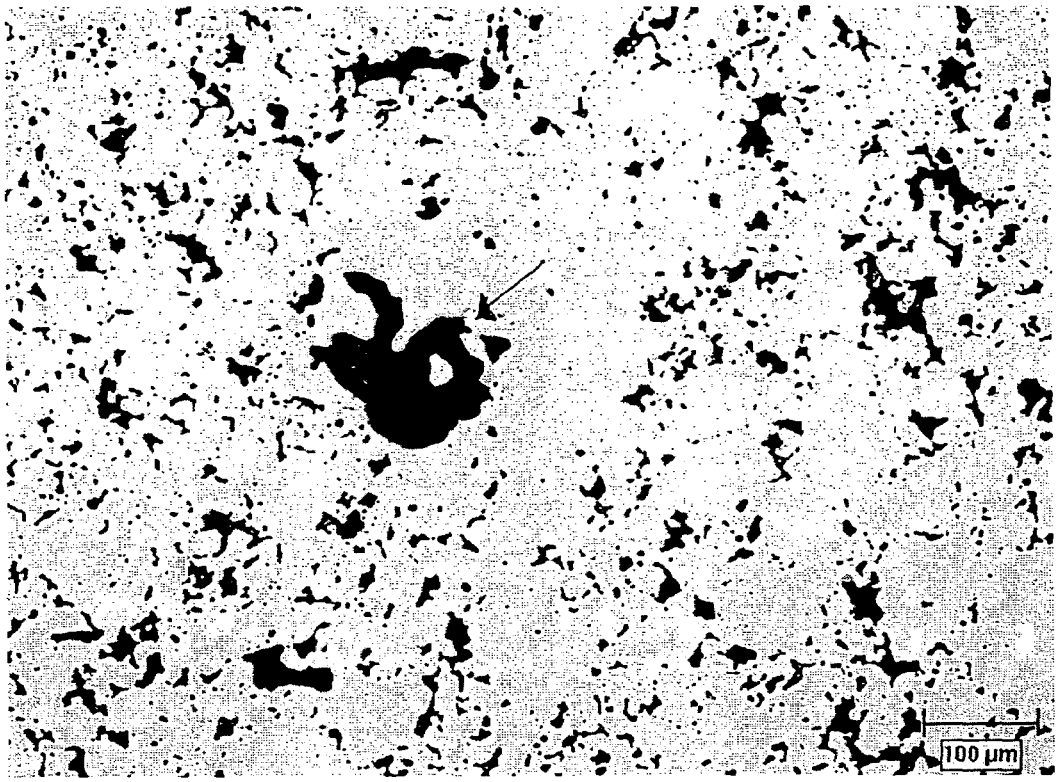
FIG. 7 is a magnified view of a sintered metallurgical powder composition prepared with 45 μm master alloy powder comprising iron, 24% chromium, and 20% silicon.

FIG. 7 is a magnified view of, Test Composition V, a sintered metallurgical powder composition prepared with 45 μm master alloy powder comprising iron, 24% chromium, and 20% silicon. Referring to FIG. 7, metallographic analysis shows that addition of large particle size master alloy powder yielded large pores caused by melting and diffusion by capillary motion.

Figure 8:
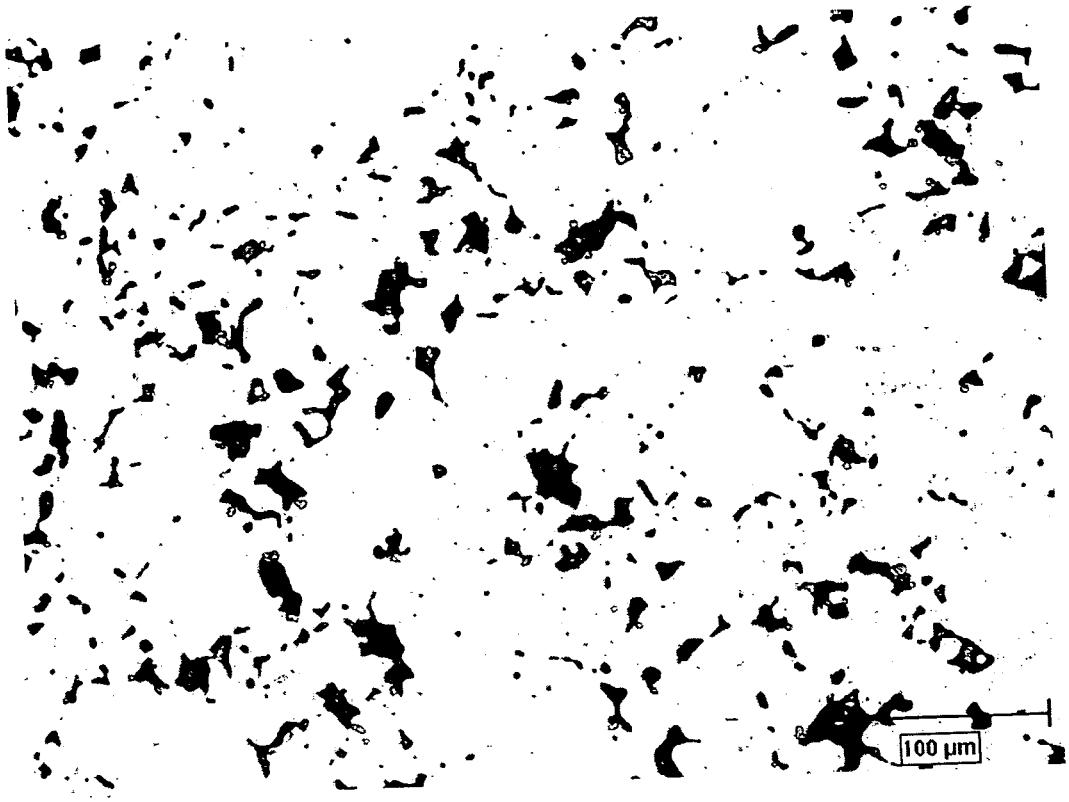
FIG. 8 is a magnified view of a sintered metallurgical powder composition prepared with 11 μm master alloy powder comprising iron, 24% chromium, and 20% silicon.

FIG. 8 is a magnified view of, Test Composition I, a sintered metallurgical powder composition prepared with 11 μm master alloy powder comprising iron, 24% chromium, and 20% silicon. Referring to FIG. 8, metallographic analysis shows that addition of small particle size master alloy powders resulted in porosity similar to the surrounding porosity of the sintered body. Without being limited by theory it is believed that large particle size master alloy powders provides for higher porosity in the final sintered component compared to lower particle size master alloy powders. Thus, metallurgical powder compositions composed of small particle size master alloy powders increased fracture toughness and fatigue life of sintered components compared to large particle size master alloy powders.

Example 3

A metallurgical powder composition composed of master alloy powders, Test Composition I, was compared to reference powders composed of expensive conventional nickel and copper alloying powders. Reference Powder III was prepared the same as Reference Powder of Example 1 except with the addition of 2.0 weight percent of a nickel alloying powder (commercially available as "Inco 123" powder from Inco Limited).

Reference Powder IV was prepared by admixing an iron-based powder (commercially available as Ancorsteel 1000B from Hoeganaes Corp.), 2.0 weight percent of a copper alloying powder (commercially available as Alcan 8081 from Alcan Inc.), 0.9 weight percent carbon (commercially available as 3203 graphite, from Asbury Graphite Mills), and 0.75 weight percent of an ethylene bis-stearamide wax lubricant (commercially available as Acrawax, from Glycol Chemical Co.), based on the total weight of Reference Powder IV.

Table 6 shows metallurgical properties for Reference Powders III & IV and Test Composition I after sintering at 2050 degrees Fahrenheit:

TABLE 6

| | Test Composition I | Reference Powder III | Reference Powder IV |
|---|---|---|---|
| Sintered Density (g/cc) | 7.04 | 7.09 | 7.09 |
| Transverse Rupture Strength (psi) | 169,000 | 190,000 | 175,000 |
| Hardness (HRA) | 53.0 | 53.8 | 54.0 |
| Yield Strength (psi) | 67,900 | 66,400 | 73,100 |
| Ultimate Tensile Strength (psi) | 88,900 | 92,700 | 94,100 |
| Elongation (%) | 1.6 | 1.9 | 1.0 |
| Impact Energy (ft · $lb_f$) | 8.0 | 12.0 | 7.0 |

Table 7 shows metallurgical properties for Reference Composition III and Test Composition I after sintering at 2300 degrees Fahrenheit:

TABLE 7

| | Test Composition I | Reference Powder III |
|---|---|---|
| Sintered Density (g/cc) | 7.06 | 7.13 |
| Transverse Rupture Strength (psi) | 204,000 | 206,000 |
| Hardness (HRA) | 53.4 | 53.5 |
| Yield Strength (psi) | 72,300 | 70,000 |
| Ultimate Tensile Strength (psi) | 99,800 | 99,000 |
| Elongation (%) | 2.7 | 2.1 |
| Impact Energy (ft · $lb_f$) | 12.7 | 20.0 |

As shown in Tables 6 & 7, the master alloy powder can be used to obtain similar mechanical properties compared to expensive nickel and copper alloying powders. For Example, when sintered at 2300 degrees Fahrenheit, Test Composition I exhibited similar or better transverse rupture strength, hardness, and ultimate tensile strength compared to Reference Powder III.

Example 4

Metallurgical powder compositions including master alloy powders were compared to a reference powder without addition of alloying powders and a reference powder composed of a silicon containing powder. Reference Powder V was prepared by admixing an iron based powder (commercially available as Ancorloy MDA, from Hoeganaes Corp.) with an ethylene bis-stearamide wax lubricant (commercially available as Acrawax, from Glycol Chemical Co.), and a conventional binder. The iron based powder was composed of a substantially pure iron powder, graphite powder, and silicon powder. As prepared, Reference Powder V included 0.9 weight percent graphite, 0.7 weight percent silicon, and 0.75 weight percent lubricant & binder.

Test Composition VI was prepared by admixing a substantially pure iron based powder (commercially available as Ancorsteel 1000B, from Hoeganaes Corp.) with 0.9 weight percent graphite additive and a master alloy. The master alloy including 24.0 weight percent chromium, 20.0 weight percent silicon, and 56 weight percent iron, based on the weight of the master alloy, and had a weight average particle size of 11 microns. With addition of the of the master alloy powder, Test Composition VI included 0.85 weight percent chromium, 0.7 weight percent silicon.

Each powder composition was pressed at 50 tons per square inch. Bars measuring 0.25 inches high, 0.5 inches wide, and 1.25 inches long were prepared for Transverse Rupture Strength testing. Additional compacts were made for further testing of mechanical properties. The compacts were then sintered in a 90% nitrogen and 10% hydrogen atmosphere at two different commercial sintering temperatures, i.e., 2050 degrees Fahrenheit and 2300 degrees Fahrenheit respectively. The compacts were then tempered at 400° Fahrenheit for 1 hour.

Table 8 shows metallurgical properties for Reference Powder V and Test Composition VI after sintering at 2050 degrees Fahrenheit:

TABLE 8

| | Test Composition VI | Reference Powder V |
|---|---|---|
| Sintered Density (g/cc) | 6.95 | 6.99 |
| Dimensional Change From Die Size (%) | 0.39 | 0.24 |
| Transverse Rupture Strength (psi) | 145,000 | 115,000 |
| Hardness (HRA) | 49 | 43 |
| Yield Strength (ksi) | 55,000 | 50,000 |
| Ultimate Tensile Strength (psi) | 70,000 | 60,000 |
| Elongation (%) | 1.7 | 1.6 |
| Impact Energy (ft · $lb_f$) | 6 | 7 |

Table 9 shows metallurgical properties for Reference Powder V and Test Composition VI after sintering at 2300 degrees Fahrenheit:

TABLE 9

| | Test Composition VI | Reference Powder V |
|---|---|---|
| Sintered Density (g/cc) | 7.01 | 7.05 |
| Dimensional Change From Die Size (%) | 0.19 | −0.03 |
| Transverse Rupture Strength (psi) | 215,000 | 165,000 |
| Hardness (HRA) | 54 | 46 |
| Yield Strength (psi) | 75,000 | 60,000 |
| Ultimate Tensile Strength (psi) | 110,000 | 95,000 |
| Elongation (%) | 3.8 | 3.8 |
| Impact Energy (ft · $lb_f$) | 13 | 16 |

As shown in Table 8 & 9, Test Composition VI exhibited better mechanical properties, such as for example higher transverse rupture strength, hardness, and ultimate tensile strength, compared to Reference Powder V when sintered at both 2050 & 2300 degrees Fahrenheit.

Example 5

Metallurgical powder compositions including master alloy powders were compared to reference powders containing a nickel powder additive. Reference Powder VI was prepared by admixing an iron based powder (commercially available as Ancorloy MDB, from Hoeganaes Corp.) and an ethylene bis-stearamide wax lubricant (commercially available as Acrawax, from Glycol Chemical Co.). The iron based powder included iron prealloyed with 0.85 weight percent molybdenum, a silicon containing powder additive, a nickel powder additive, and graphite. As prepared, Reference Powder VI included 0.7 weight percent silicon, 2.0 weight percent nickel, 0.6 weight percent carbon, and 0.75 weight percent of lubricant & binder. Reference Powder VII was the same as Reference Powder VI, except that it contained 4.4 weight percent nickel and is commercially available as Ancorloy MDC, from Hoeganaes Corp.

Test Composition VIII was prepared by admixing the iron based powder of Example 1, a master alloy powder, and 1.0 weight percent nickel powder additive. The master alloy powder included 24.0 weight percent chromium, 20.0 weight percent silicon, and 56 weight percent iron, based on the weight of the master alloy, and had a weight average particle size of 11 microns. With addition of the master alloy powder, Test Composition VIII included 0.85 weight percent chromium and 0.7 weight percent silicon. Test Composition IX was the same as Test Composition VIII, except that it included 3.0 weight percent nickel.

Each powder composition was pressed at 50 tons per square inch. Bars measuring 0.25 inches high, 0.5 inches wide, and 1.25 inches long were prepared for Transverse Rupture Strength testing. Additional compacts were made for further testing of mechanical properties. The compacts were then sintered in a 90% nitrogen and 10% hydrogen atmosphere at two different commercial sintering temperatures, i.e., 2050 degrees Fahrenheit and 2300 degrees Fahrenheit respectively. The bars were then tempered at 400° Fahrenheit for 1 hour.

Table 10 shows metallurgical properties for Reference Powders VI & VII and Test Compositions VIII & IX after sintering at 2050 degrees Fahrenheit:

TABLE 10

| | Test Composition VIII | Reference Powder VI | Test Composition IX | Reference Powder VII |
|---|---|---|---|---|
| Nickel Content (Weight %) | 1.0 | 2.0 | 3.0 | 4.4 |
| Sintered Density (g/cc) | 7.1 | 7.14 | 7.12 | 7.18 |
| Dimensional Change From Die Size (%) | 0.19 | 0.08 | 0.09 | −0.02 |
| Transverse Rupture Strength (psi) | 230,000 | 215,000 | 240,000 | 230,000 |
| Hardness (HRA) | 62 | 60 | 65 | 64 |
| Yield Strength (psi) | 95,000 | 90,000 | 95,000 | 92,000 |

TABLE 10-continued

| | Test Composition VIII | Reference Powder VI | Test Composition IX | Reference Powder VII |
|---|---|---|---|---|
| Ultimate Tensile Strength (psi) | 115,000 | 110,000 | 130,000 | 130,000 |
| Elongation (%) | 1.2 | 1.0 | 1.5 | 1.9 |
| Impact Energy (ft · $lb_f$) | 8 | 9 | 9 | 9 |

Table 11 shows metallurgical properties for Reference Powders VI & VII and Test Compositions VIII & IX after sintering at 2300 degrees Fahrenheit:

TABLE 11

| | Test Composition VIII | Reference Powder VI | Test Composition IX | Reference Powder VII |
|---|---|---|---|---|
| Nickel Content (Weight %) | 1.0 | 2.0 | 3.0 | 4.4 |
| Sintered Density (g/cc) | 7.13 | 7.16 | 7.16 | 7.26 |
| Dimensional Change From Die Size (%) | 0.10 | −0.23 | 0.0 | −0.32 |
| Transverse Rupture Strength (psi) | 325,000 | 270,000 | 375,000 | 350,000 |
| Hardness (HRA) | 64 | 62 | 69 | 68 |
| Yield Strength (psi) | 110,000 | 90,000 | 125,000 | 125,000 |
| Ultimate Tensile Strength (psi) | 160,000 | 130,000 | 190,000 | 185,000 |
| Elongation (%) | 2.2 | 2.5 | 2.5 | 2.7 |
| Impact Energy (ft · $lb_f$) | 19 | 19 | 23 | 23 |

As shown in Table 10 & 11, the addition of master alloy powders enables a reduction in nickel content metallurgical powder compositions without detrimentally affected mechanical properties. Test Compositions VIII and IX exhibited improved mechanical properties, such as for example transverse rupture strength, hardness, and ultimate tensile strength compared to Reference Powders VI and VII. Moreover, after sintering at 2300 degrees Fahrenheit, Test Composition IX exhibited 0.0% dimensional change from die size to final sintered size.

Example 6

Test Composition IX and Reference Powders VII & VIII were compacted at various compaction pressures and compared. Reference Powder VIII was prepared by admixing an iron based powder, a nickel powder additive, graphite, and an ethylene bis-stearamide wax lubricant. Reference Powder VIII is commercially available as FLN4-4405 from Hoeganaes Corp. The iron based powder included iron prealloyed with 0.85 weight percent molybdenum. As prepared, Reference Powder VIII included 4.0 weight percent nickel, 0.6 weight percent carbon, and 0.75 weight percent of lubricant & binder.

Each powder composition was compacted at 30, 40, 50, and 55 tons per square inch. The compacts were then sintered in a 90% nitrogen and 10% hydrogen atmosphere at 2300 degrees Fahrenheit. The compacts were then tempered at 400° Fahrenheit for 1 hour.

Table 12 shows dimensional change properties and ultimate tensile strength properties for Reference Powders VII & VII and Test Composition IX after sintering at 2300 degrees Fahrenheit:

TABLE 12

| | Compaction Pressure (tsi) | Sintered Density (g/cc) | Ultimate Tensile Strength (psi) | Dimensional Change (%) |
|---|---|---|---|---|
| Test Composition IX | 30 | 6.94 | 151,800 | −0.13 |
| | 40 | 7.15 | 178,000 | −0.05 |
| | 50 | 7.28 | 182,900 | 0.00 |
| | 55 | 7.30 | 191,200 | 0.03 |
| Reference Powder VII | 30 | 7.02 | 145,200 | −0.54 |
| | 40 | 7.22 | 163,600 | −0.39 |
| | 50 | 7.34 | 181,000 | −0.28 |
| | 55 | 7.38 | 180,300 | −0.25 |
| Reference Powder VIII | 30 | 7.06 | 123,200 | −0.58 |
| | 40 | 7.29 | 143,900 | −0.44 |
| | 50 | 7.42 | 154,400 | −0.37 |
| | 55 | 7.46 | 157,200 | −0.32 |

Figure 9:
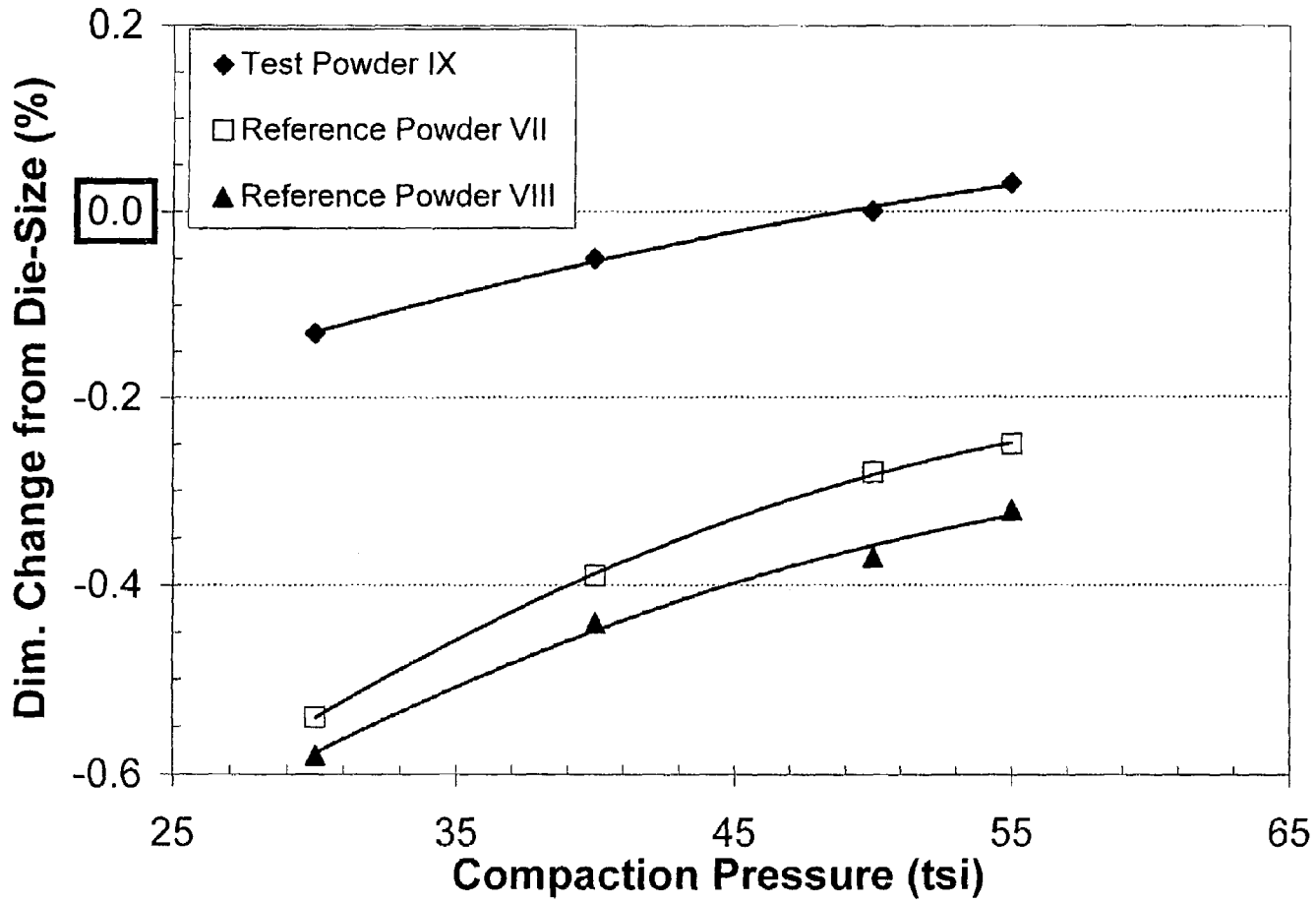
FIG. 9 is an X-Y graph of data points for dimensional change characteristics of metallurgical powder compositions as a function of compaction pressure after sintering at 2300 degrees Fahrenheit.
Figure 10:
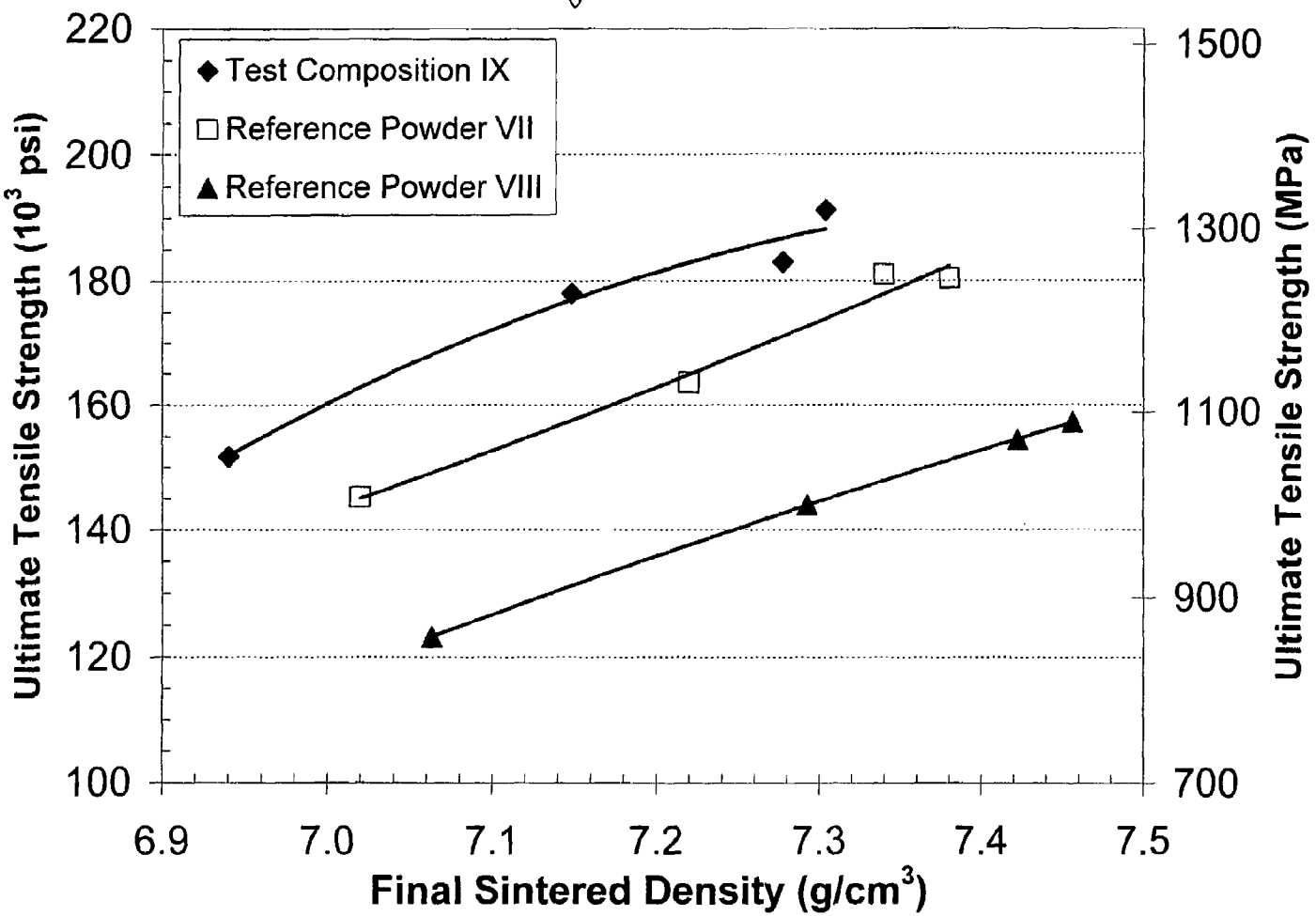
FIG. 10 is an X-Y graph of data points for ultimate tensile strength properties of metallurgical powder compositions as a function of final sintered density after sintering at 2300 degrees Fahrenheit.

FIG. 9 is an X-Y graph of data points for dimensional change characteristics of metallurgical powder compositions as a function of compaction pressure after sintering at 2300 degrees Fahrenheit. FIG. 10 is an X-Y graph of data points for ultimate tensile strength properties of metallurgical powder compositions as a function of final sintered density after sintering at 2300 degrees Fahrenheit. Referring to FIGS. 9 & 10, Test Composition IX exhibited lower dimensional change from die size when compacted at 30–55 tons per square inch compared to Reference Powders VII & VIII. At similar densities, Test Composition IX exhibited greater ultimate tensile strength compared to Reference Powders VII & VIII.

There have thus been described certain preferred embodiments of metallurgical powder compositions and methods of making the same. While preferred embodiments have been disclosed and described, it will be recognized by those with skill in the art that variations and modifications are within the true spirit and scope of the invention.

What is claimed is:

1. A powder metallurgy composition comprising:

at least about 80 weight percent of an iron-based metallurgical powder, based on the total weight of the powder metallurgy composition; and from about 0.10 to about 20 weight percent of a master alloy powder, based on the total weight of the powder metallurgy composition, comprising:

at least about 35 weight percent iron, from about 1.0 to about 40 weight percent chromium, and from about 15 to about 22 weight percent silicon, based on the total weight of the master alloy powder.

2. The powder metallurgy composition of claim 1 wherein the master alloy powder comprises about 24 weight percent chromium and about 20 weight percent silicon.

3. The powder metallurgy composition of claim 1 wherein the master alloy powder comprises about 29 weight percent chromium and about 18 weight percent silicon.

4. The powder metallurgy composition of claim 1 wherein the master alloy powder comprises from about 10 to about 35 weight percent chromium.

5. The powder metallurgy composition of claim 1 wherein the iron-based powder comprises at least 90 weight percent iron.

6. The powder metallurgy composition of claim 5 wherein the master alloy powder comprises from about 10 to about 35 weight percent chromium.

7. A powder metallurgy composition comprising:

at least about 80 weight percent of an iron-based powder, based on the total weight of the powder metallurgy composition; wherein the iron-based powder comprises at least 90 weight percent iron, and from about 0.10 to about 20 weight percent of a master alloy powder, based on the total weight of the powder metallurgy composition, comprising:

at least about 35 weight percent iron, from about 10 to about 35 weight percent chromium, and from about 10 to about 35 weight percent silicon, from about 10 to about 30 weight percent manganese, based on the total weight of the master alloy powder.

8. The powder metallurgy composition of claim 7 wherein the master alloy powder comprises about 20 weight percent chromium, about 14 weight percent silicon, and about 20 weight percent manganese.

9. A powder metallurgy composition comprising:

at least about 80 weight percent of an iron-based metallurgical powder, based on the total weight of the powder metallurgy composition; and from about 0.10 to about 20 weight percent of a master alloy powder, based on the total weight of the powder metallurgy composition, comprising:

at least about 35 weight percent iron, from about 10 to about 35 weight percent chromium, from about 10 to about 35 weight percent silicon, from about 10 to about 35 weight percent manganese, and from about 5 to about 25 weight percent nickel, based on the total weight of the master alloy powder.

10. The powder metallurgy composition of claim 1 wherein the weight average particle size of the master alloy powder is less than or equal to about 37 microns.

11. The powder metallurgy composition of claim 1 wherein the weight average particle size of the master alloy powder is less than or equal to about 11 microns.

12. The powder metallurgy composition of claim 7 wherein the weight average particle size of the master alloy powder is less than or equal to about 11 microns.

13. A method of making a sintered part comprising the steps of a. providing a metallurgical powder composition comprising:

a major amount of iron-based powder, and a minor amount of an iron-based prealloyed master alloy powder comprising:

from about 10 to about 35 weight percent chromium, and from about 15 to about 22 weight percent silicon, based on the total weight of the master alloy powder;

b. compacting the metallurgical powder composition in a die at a pressure of about 30–80 tons per square inch; and c. sintering the compacted metallurgical powder composition at a temperature of at least about 2000° F.

14. The powder metallurgy composition of claim 7 wherein the weight average particle size of the master alloy powder is less than or equal to about 37 microns.

15. The powder metallurgy composition of claim 9 wherein the weight average particle size of the master alloy powder is less than or equal to about 37 microns.

16. The powder metallurgy composition of claim 9 wherein the weight average particle size of the master alloy powder is less than or equal to about 11 microns.

17. The powder metallurgy composition of claim 1 wherein the master alloy powder further comprises from about 15 to about 25 weight percent manganese.

18. The powder metallurgy composition of claim 7 wherein the master alloy powder further comprises from about 15 to about 25 weight percent manganese.

19. The powder metallurgy composition of claim 9 wherein the master alloy powder further comprises from about 15 to about 25 weight percent manganese.

20. The powder metallurgy composition of claim 1 further comprising from about 0.1 to about 5.0 weight percent carbon.

21. The powder metallurgy composition of claim 1 wherein the master alloy powder further comprises from about 0.1 to about 1.0 weight percent of particulate, elemental carbon.

22. The powder metallurgy composition of claim 1 wherein the master alloy powder is a prealloy comprising from about 0.1 to about 1.0 weight percent of carbon.

23. The powder metallurgy composition of claim 7 further comprising from about 0.1 to about 5.0 weight percent carbon.

24. The powder metallurgy composition of claim 7 wherein the master alloy powder further comprises from about 0.1 to about 1.0 weight percent of particulate, elemental carbon.

25. The powder metallurgy composition of claim 7 wherein the master alloy powder is a prealloy comprising from about 0.1 to about 1.0 weight percent of carbon.

26. The powder metallurgy composition of claim 9 further comprising from about 0.1 to about 5.0 weight percent carbon.

27. The powder metallurgy composition of claim 9 wherein the master alloy powder further comprises from about 0.1 to about 1.0 weight percent of particulate, elemental carbon.

28. The powder metallurgy composition of claim 9 wherein the master alloy powder is a prealloy comprising from about 0.1 to about 1.0 weight percent of carbon.

29. A powder metallurgy composition comprising:

at least about 80 weight percent of an iron-based metallurgical powder, based on the total weight of the powder metallurgy composition; and from about 0.10 to about 20 weight percent of a master alloy powder, based on the total weight of the powder metallurgy composition, comprising iron, chromium, manganese, and from about 10 to about 35 weight percent silicon, based on the total weight of the master alloy powder.

30. The powder metallurgy composition of claim 29 wherein the master alloy powder is composed of from about 15 to about 22 weight percent silicon, based on the total weight of the master alloy powder.

31. The powder metallurgy composition of claim 29 wherein the master alloy powder is composed of at least about 35 weight percent iron, and from about 10 to about 35 weight percent chromium, based on the total weight of the master alloy powder.

32. The powder metallurgy composition of claim 30 wherein the master alloy powder is composed of at least about 35 weight percent iron, and from about 10 to about 35 weight percent chromium, based on the total weight of the master alloy powder.

* * * * *

UNITED STATES PATENT AND TRADEMARK OFFICE

CERTIFICATE OF CORRECTION

PATENT NO. : 7,153,339 B2
APPLICATION NO. : 10/818782
DATED : December 26, 2006
INVENTOR(S) : Lindsley et al.

It is certified that error appears in the above-identified patent and that said Letters Patent is hereby corrected as shown below:

Column 11, lines 21-36, replace Table 3a with the following:

Table 3a

| | Particle Size (µm) | Transverse Rupture Strength (psi) | Yield Strength (ksi) | % Elongation | Ultimate Tensile Strength (psi) |
|---|---|---|---|---|---|
| Test Composition I | 11 | 170,000 | 67.9 | 1.63 | 88,900 |
| Test Composition II | 8 | 168,000 | -- | -- | -- |
| Test Composition III | 18 | 159,000 | -- | -- | -- |
| Test Composition IV | 26 | 153,000 | -- | -- | -- |
| Test Composition V | 45 | 141,000 | 56.2 | 1.51 | 69,500 |

Column 11, lines 40-46, replace Table 3 with the following:

Table 3b

| | Particle Size (µm) | Yield Strength (ksi) | % Elongation | Ultimate Tensile Strength (psi) |
|---|---|---|---|---|
| Test Composition I | 11 | 67.9 | 1.63 | 88,900 |
| Test Composition V | 45 | 56.2 | 1.51 | 69,500 |

Column 14, line 41, after "Yield Strength," delete "(ksi)" and replace with --(psi)--.

Column 18, line 23, delete "and."

Column 18, line 24, after "weight percent silicon," add --and--.

UNITED STATES PATENT AND TRADEMARK OFFICE

CERTIFICATE OF CORRECTION

PATENT NO. : 7,153,339 B2
APPLICATION NO. : 10/818782
DATED : December 26, 2006
INVENTOR(S) : Lindsley et al.

It is certified that error appears in the above-identified patent and that said Letters Patent is hereby corrected as shown below:

Column 19, line 19, delete "further."

Column 19, line 22, delete "further."

Signed and Sealed this

Thirteenth Day of November, 2007

JON W. DUDAS
*Director of the United States Patent and Trademark Office*